United States Patent [19]

Jackemeyer

[11] Patent Number: 4,496,146

[45] Date of Patent: Jan. 29, 1985

[54] COMPRESSIBLE PORTABLE EXERCISING APPARATUS WITH CONTAINER

[76] Inventor: James E. Jackemeyer, 21 Cedar St., Gardner, Mass. 01440

[21] Appl. No.: 403,730

[22] Filed: Jul. 30, 1982

Related U.S. Application Data

[62] Division of Ser. No. 130,747, Mar. 17, 1980, abandoned.

[51] Int. Cl.[3] ..... A01B 5/22

[52] U.S. Cl. ..... 272/74; 206/315.1

[58] Field of Search ..... 272/74, 75; 46/220; 273/425; 150/49; 206/321, 443, 577, 579

[56] References Cited

U.S. PATENT DOCUMENTS

| | | | |
|---|---|---|---|
| 1,533,636 | 4/1925 | Day | 150/49 |
| 3,311,118 | 3/1967 | Gutner | 206/577 X |
| 3,587,697 | 6/1971 | Silfverskiold | 150/49 X |
| 3,633,925 | 1/1972 | Deese | 272/75 |
| 3,669,133 | 6/1972 | Hyman | 272/75 UX |
| 3,762,704 | 10/1973 | Gingras | 272/75 |
| 3,778,053 | 12/1973 | Smith et al. | 272/75 |
| 3,843,238 | 10/1974 | Rushing et al. | 272/65 X |
| 3,881,277 | 5/1975 | Delph et al. | 46/220 |
| 3,958,802 | 5/1976 | Thornton | 272/74 |
| 4,210,323 | 7/1980 | Feather | 272/137 |
| 4,253,673 | 3/1981 | Bailey | 206/579 X |
| 4,380,885 | 4/1983 | Komagata | 46/220 |

*Primary Examiner*—Richard T. Stouffer

*Attorney, Agent, or Firm*—David A. Lundy

[57] ABSTRACT

An exercise apparatus for manipulation by a user includes a self-supporting member of a generally quadrilateral configuration which is compressible to be held in a container. The member has opposite distal and proximal portions that are joined by a pair of generally perpendicularly disposed side portions of equal length. The proximal portion having a longitudinal axis. In use, the distal portion is revolvable about the longitudinal axis of the proximal portion.

13 Claims, 4 Drawing Figures

COMPRESSIBLE PORTABLE EXERCISING APPARATUS WITH CONTAINER

CROSS REFERENCE TO RELATED APPLICATION

This is a divisional application of U.S. Patent Application Ser. No. 130,747 entitled "Exercise Apparatus" filed on Mar. 17, 1980, now abandoned.

BACKGROUND OF THE INVENTION

The field of the invention relates to exercise apparatus, and more particularly, to exercise apparatus of a single piece construction.

Exercise apparatus of the past include devices having a hand held end about which the device rotates. U.S. Pat. No. 3,633,925 teaches a rope jumping device that comprises a relatively rigid U-shaped rod connected to a flexible line. U.S. Pat. No. 3,958,802 teaches a jumping hoop having a hand held member, which appears relatively rigid, connected to a relatively flexible second U-shaped member. U.S. Pat. No. 4,094,502 discloses a skipping exercise device wherein the hand held and distal ends are hingedly connected at a point along each longer side thereof. U.S. Pat. No. 104,674 discloses a skipping hoop of uniform rigidity which may be modified into a trundling hoop by removing the handle thereof. U.S. Pat. No. 67,101 discloses a jumping hoop of uniform rigidity having the hand piece thereof attached to a hoop. U.S. Pat. No. 2,493,224 teaches a circular skipping hoop of uniform rigidity comprising an endless circular member having a handle means connected thereto.

None of these past devices can be readily constructed from a single element formed into a generally quadrilateral configuration suitable for exercising, and in particular, a device of a uniform rigidity formed into a shape for performing a rope skipping exercise. Consequently, the construction of these past devices is relatively expensive from the standpoints of both material and labor. Further, such devices are therefore, because of the greater number of constituent parts, more complex than necessary.

Thus, it would be highly desirable to provide an improved exercise apparatus. It would also be highly desirable to provide an improved exercise apparatus that may be manufactured at a relatively low cost from the standpoints of both labor and materials.

It would also be highly desirable to provide an improved exercise apparatus that is not vulnerable to breakage due to having a number of constituent parts.

It would also be highly desirable to provide an improved exercise apparatus that does not pose a danger of injury to the user due to having a number of constituent parts.

Further, none of the past devices are collapsible for convenient storage and handling upon the simple manual disassembly of one portion thereof.

Thus, it would be highly desirable to provide an improved exercise apparatus which is collapsible for convenient storage and handling upon the simple manual disassembly of a single portion thereof.

SUMMARY OF THE INVENTION

It is therefore an object of the invention to provide an improved exercise apparatus.

It is another object of the invention to provide an improved exercise apparatus which is economically constructed with a minimum of materials and labor costs.

It is another object of the invention to provide an improved exercise apparatus which is readily constructed from a single element of uniform rigidity.

It is another object of the invention to provide an improved exercise apparatus which minimizes the possibility of structural failure.

It is still another object of the invention to provide an improved rope skipping device which is easily disassembled for convenient storage and handling.

Finally, it is another object of the invention to provide an improved rope skipping device which is readily assembled for operation.

The invention, in its broader aspects, is an exercise device comprised of a self-supporting member of a generally quadrilateral configuration. The member has opposite distal and proximal portions joined by a pair of generally perpendicularly disposed side portions of equal length. The proximal portion has a longitudinal axis. The distal portion is revolvable about the longitudinal axis of the proximal portion.

BRIEF DESCRIPTION OF THE DRAWINGS

The above mentioned and other features and objects of this invention and the manner of attaining them will become more apparent and the inventiion itself will be best understood by reference to the following description of the invention taken in conjunction with the accompanying drawings wherein.

DESCRIPTION OF A SPECIFIC EMBODIMENT

Figure 1:
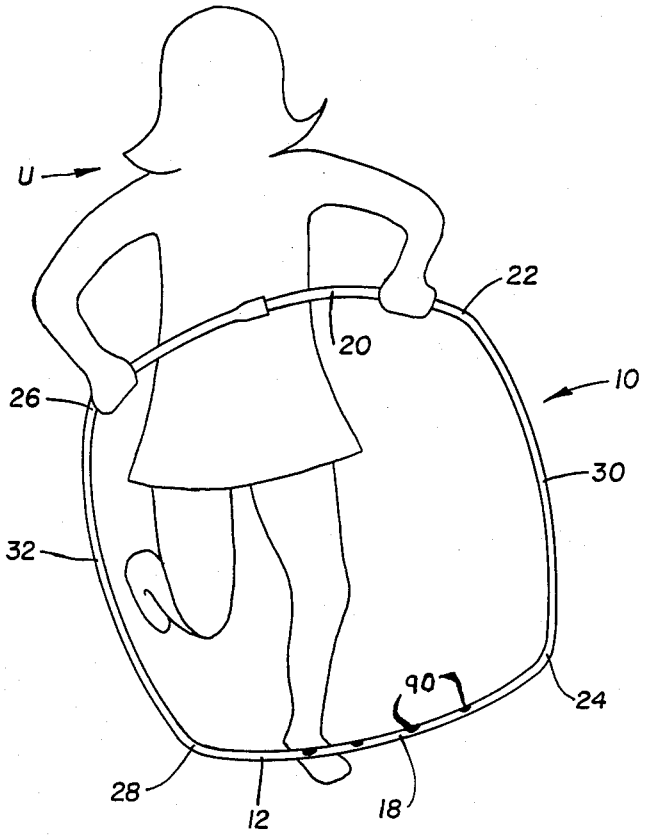
FIG. 1 is a perspective view of a specific embodiment of the apparatus being manipulated by a user.

FIG. 1 illustrates a specific embodiment of the exercise apparatus 10 as it would be utilized by an individual user U. The exercise apparatus 10 is comprised of a single elongated tube 12 having opposite ends 14, 16 and being of a generally quadrilateral configuration. The apparatus 10 is detachable at the opposite ends 14, 16 thereof as will hereinafter be more fully described. The apparatus 10 has opposite distal 18 and proximal 20 portions joined together in a generally parallel and spaced-apart fashion at junctures 22, 24 and 26, 28 by a pair of generally perpendicularly disposed side portions 30 and 32, respectively. The specific configuration being trapezoidal wherein the proximal 20 and distal 18 portions are generally parallel. It is also seen that the distal 18 and proximal 20 portions and the side portions 30 and 32 bow outward from a point. This point being the intersections of lines bisecting the opposite interior angles of the tube 12.

Figure 2:
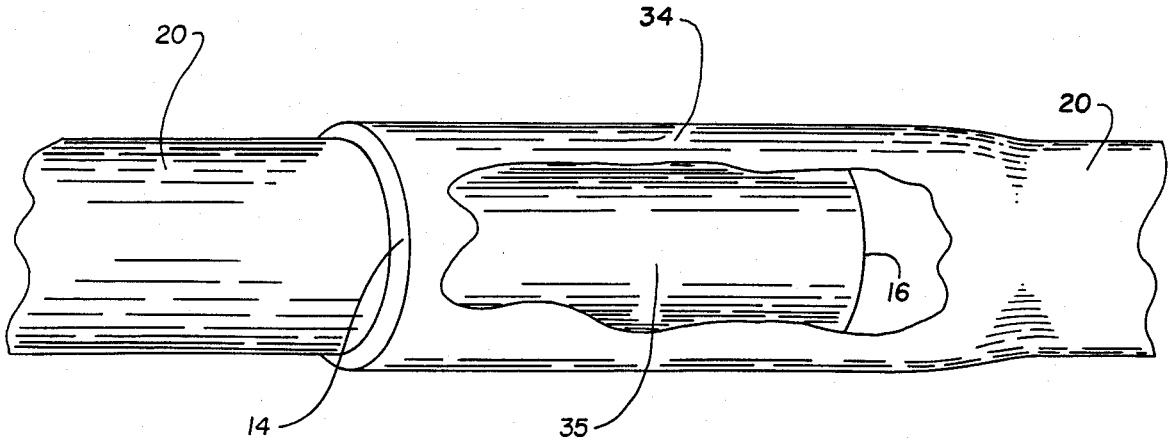
FIG. 2 is a fragmentary and cut-away detail view of the junction of the end portions of a single piece of tubing in a specific embodiment of the apparatus.

As illustrated in FIG. 2, one end portion 34 of the tube 12 is flared to such a degree so as to be able to receive the other end portion 35. The other end portion 35 is frictionally fit within the one end portion 34 so as to effectively maintain the quadrilateral configuration of the tube 12 during use. However, the opposite end portions 34, 35 may be easily disengaged as hereinafter is more fully described.

In operation, the user U manipulates the exercise apparatus 10 about the user's U body so as to generate a toroidal circumscription of the user's body.

The apparatus 10 as illustrated may be conveniently constructed utilizing a single length of tubing 12 formed with rounded corners so as to be joined one end 14 to the other 16. Any light weight self-supporting tubular structure may be used, such as aluminum or a plastic such as polyethylene.

Figure 3:
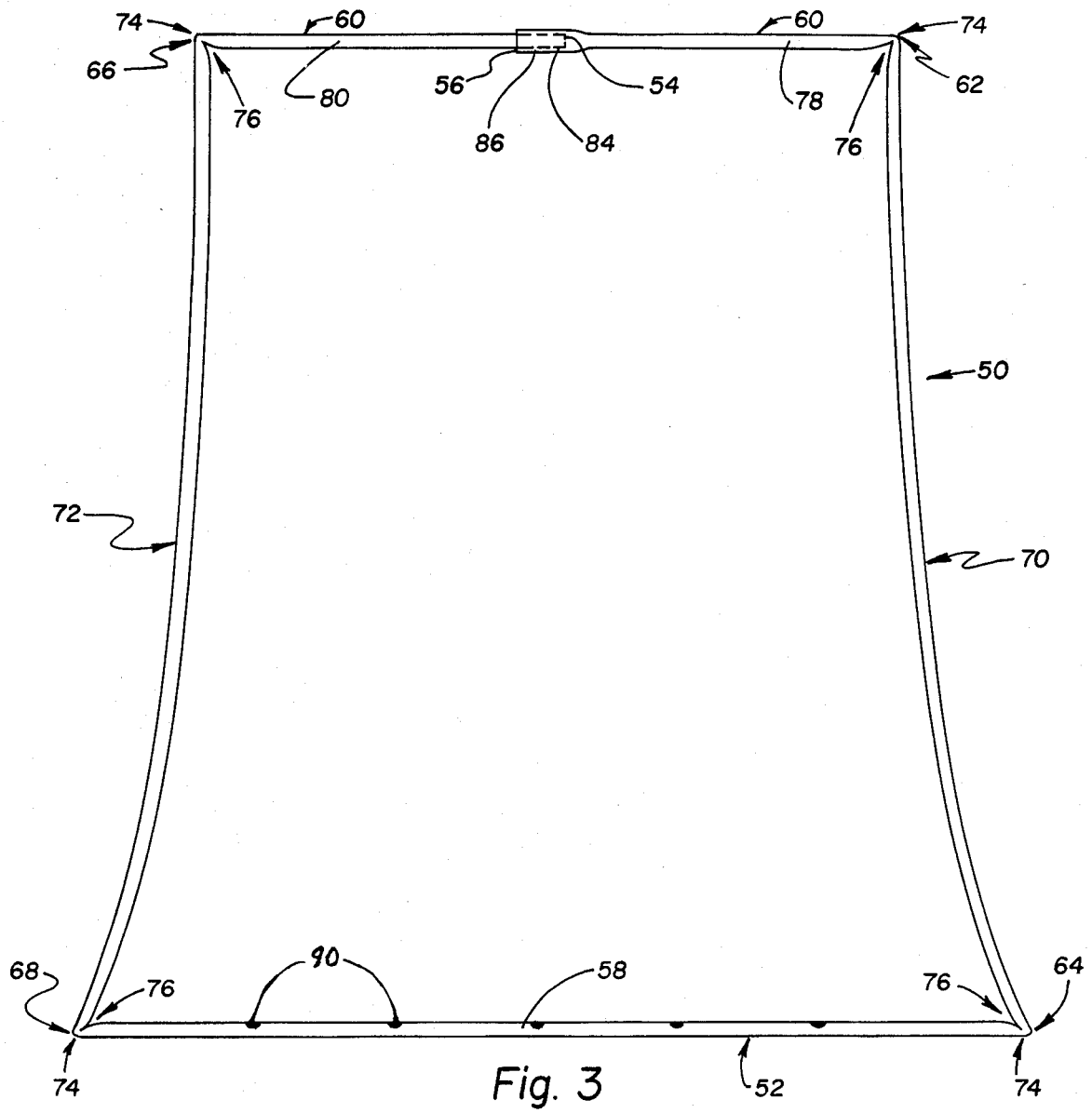
FIG. 3 illustrates a slight modification of the specific embodiment of the invention having crimped hinged corners.

Referring now to FIG. 3 wherein the modified embodiment of the exercise apparatus 50 is illustrated, the exercise apparatus 50 is comprised of single elongated tube 52 of plastic material such as polyethylene and having opposite ends 54, 56 and being of a generally quadrilateral configuration. The apparatus 50 is detachable at the opposite ends 54, 56 thereof as hereinafter is more fully described.

The apparatus 50 has opposite distal 58 and proximal 60 portions joined together in a generally parallel and spaced-apart fashion at junctures 62, 64 and 66, 68 by a pair of generally perpendicularly disposed side portions 70 and 72, respectfully. The specific configuration is trapezoidal wherein the proximal 60 and distal 58 portions are generally parallel. It is also seen that the proximal 60 and distal 58 portions and the side portions 70, 72 bow inward toward a point. This point is the intersections of the lines bisecting the opposite interior angles of the tube 52.

The distal portion 58 is longer than the proximal portion 60 and in this manner, inasmuch as the vertical side portions 70, 72 remain of equal length, a trapezoidal configuration results. In this embodiment, the junctures 62, 64, 66, 68 are formed by crimps in the structure of the elongated tube which form hinges 74. Each hinge 74 includes a crease 76 at which the hinge 74 pivots. The opposing spring like action of the crimps at the junctures 62, 64, 66, 68 serves to maintain the generally trapezoidal configuration of the exercise apparatus 50.

As illustrated, one or more whistles or sound generating holes 90 may be added to the apparatus 50 or any other embodiment of the invention. Such whistles or holes 90 are most effectively located on or near the distal portion 58 so as to experience the greatest velocity with respect to the air mass when the apparatus 50 is in use. In this regard, holes 90 may be drilled into tube 52 along any inward or outward facing portion of its length such that air will be forced tangentially across the opening formed by holes 90.

Figure 3A:
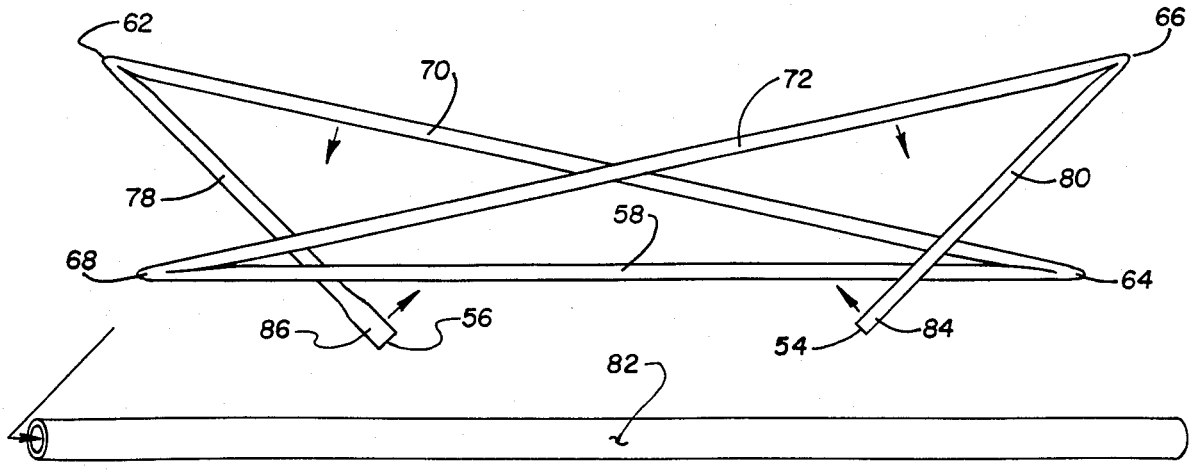
FIG. 3A is a partially folded disassembled view of the modified embodiment of the apparatus illustrating the collapsible feature for storage in a tubular container or box.

Referring now to FIG. 3A, a manual tractional force may be applied to the oppositely disposed sections 78 and 80 of the proximal portion 60 so as to frictionally release the one end portion 84 from the other flared end portion 86 and allow the structure of the apparatus 50 to collapse. In this manner, by thereafter manually decreasing the angles " " at the junctures 62, 64, 66 and 68 to approximately zero degrees (0°), the structure of the invention folds on itself. Thereby, the distal portion 58 is aligned so as to be generally parallel with the pair of generally perpendicularly disposed side portions 70 and 72. Additionally, the opposite sections 78, 80 of the proximal portion 60 become aligned with themselves and aligned with the distal portion 58. In this disassembled condition, the pair of perpendicularly disposed side portions 70, 72, the distal portion 58 and the proximal portion 60 are in a generally parallel relationship so that the entire structure of the exercise apparatus 50 takes on an elongated configuration thereby enabling the entire structure of the exercise apparatus 50 to be readily inserted or slidably received into an elongated storage tube 82 or similar container to facilitate storage, transport and/or handling.

When first inserted within the storage tube 82, the exercise apparatus 50 is compressed so as to easily slide into the tube 82. However, once within the tube 82, the exercise apparatus 50 expands so that it engages the interior wall of the tube 82. This engagement frictionally holds the exercise apparatus 50 within the tube 82, and inhibits the exercise apparatus 50 from inadvertently exiting the storage tube 82. In order to exit the tube 82, the apparatus 50 must be pulled from the tube 82.

When the apparatus 50 is removed from the tube 82, the resilience of a plastic like polyethylene provides the required flexibility and insures that the tube 52 will return to its original shape or configuration without breakage. The connection of the apparatus 50 at the juncture of end portions 84, 86 of the elongated tube 52 insures the apparatus 50 will be held in the position shown in FIG. 3.

Thus, it is seen that applicant's invention provides an improved exercise apparatus constructed of a single tube of a uniform rigidity. Applicant's structure is one of ultimate simplicity. Finally, it is seen that one embodiment of applicant's apparatus provides an improved exercise apparatus which may be easily disassembled and folded upon itself into a generally elongated configuration so as to securely fit within an elongated tube or container. The ability to be inserted in such a container is a great improvement over prior devices and enhances the ability of the exercise apparatus of the invention to be stored and economically transported or handled.

While there have been described above the principles of this invention in connection with specific apparatus, it is to be clearly understood that this description is made only by way of example and not as a limitation to the scope of the invention.

What is claimed is:

1. An exercise apparatus for manipulation by a user comprising a self-supporting member of a generally quadralateral configuration having opposite distal and proximal portions joined by a pair of generally perpendicularly disposed portions of equal length, said portions each having longitudinal axes, said distal portion being revolvable about said longitudinal axis of said proximal portion while said axes are in the same plane in performing a jumping exercise, said distal and proximal portions are hingedly joined to said generally perpendicularly disposed portions, said self-supporting member being collapsible by disconnection of said self-supporting member at a circumferential point along said member, and further including a container, said generally perpendicularly disposed, distal and proximal portions being folded into an elongated configuration, said member in said folded condition being slideably received into said container and frictionally held therein.

2. The exercise apparatus of claim 1 wherein said rigid member is a single continuous length of tube having adjoining opposite ends.

3. The exercise apparatus of claim 2 wherein one of said end portions is flared, said one end portion receives other end portion.

4. The exercise apparatus of claim 1 wherein said quadrilateral configuration is a trapezoid.

5. The exercise apparatus of claim 1 wherein said self-supporting member has one or more whistle holes therein.

6. The exercise apparatus of claim 1 wherein said member has opposite ends, said circumferential point is the juncture of said opposite ends.

7. The exercise apparatus of claim 1 wherein said member is formed of tubing.

8. The exercise apparatus of claim 7 wherein one of said end portions is flared so as to receive an other of said end portions.

9. The exercise apparatus of claim 1 wherein said distal and proximal portions are hingedly joined to said generally perpendicularly disposed portions, said self-supporting member being collapsible by disconnection of said self-supporting member at a circumferential point along said member, said proximal and distal portions and said generally perpendicularly disposed portions bow outward from a point, said point being the intersections of lines bisecting opposite interior angles of said self-supporting member.

10. A portable exercise apparatus for manipulation by a user comprising: a container, a self-supporting elongated member of a generally quadrilateral configuration, said member having spaced-apart distal and proximal portions hingedly joined to side portions of equal length, said member being disjoined at opposite ends thereof, said side, distal and proximal portions being folded upon one another into a generally parallel relationship with one another to form a compressible elongated configuration, said member in said folded condition being compressed to an extent to be received within said container, and said member in said folded condition being frictionally held in said container.

11. A portable exercise apparatus and container combination comprising: a self-supporting member of a generally quadrilateral configuration, said member having spaced-apart distal and proximal portions hingedly joined to side portions of equal length, said member is of a single continuous length having opposite ends, said rigid member being collapsible by disconnection at said opposite ends thereof, and a container, said member in said collapsed condition being received in said container and frictionally held therein.

12. The invention of claim 11 wherein said member when in said collapsed condition is folded into an elongated configuration, said member when in said elongated configuration being slidably received into said container and frictionally held therein.

13. The invention of claim 11 wherein said opposite ends are along a length of said proximal portion, said member when in said collapsed condition has said side portions and opposite sections of said proximal portion overlaying said distal portions, said member when collapsed being a compressible elongated configuration said member when in said elongated configuration and in a compressed condition being slidably received into said container and frictionally held therein.

* * * * *